US006166892A

United States Patent [19]

Wu

[11] Patent Number: 6,166,892

[45] Date of Patent: Dec. 26, 2000

[54] CONNECTOR WITH BUILT-IN RESETTABLE POWER REGULATION

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/336,096

[22] Filed: Jun. 18, 1999

[30] Foreign Application Priority Data

Dec. 18, 1998 [TW] Taiwan ..... 87121200

[51] Int. Cl.[7] ..... H02H 3/18

[52] U.S. Cl. ..... 361/79; 361/78; 361/91.1

[58] Field of Search ..... 361/79, 86, 87, 361/78, 91.1, 93.1, 800, 752, 824; 439/660, 692

[56] References Cited

U.S. PATENT DOCUMENTS 5,221,212 6/1993 Davis ..... 439/108

5,785,557 7/1998 Davis ..... 439/660

6,036,549 3/2000 Wulff ..... 439/660

*Primary Examiner*—Michael J. Sherry

*Attorney, Agent, or Firm*—WeiTe Chung

[57] ABSTRACT

An electrical connector includes an insulative housing retaining signal and power contacts therein. A resettable power regulation device is attached to the housing and electrically connected to the power contact whereby an excessive-power condition caused by an excessive-current or excessive-voltage power signal transmitted through the power contact triggers a shut-down operation of the regulation device thereby terminating transmission of the power signal to protect an electrical device connected to the connector. The resettable power regulation device resumes transmission when the power condition decreases to an operational level.

14 Claims, 5 Drawing Sheets

CONNECTOR WITH BUILT-IN RESETTABLE POWER REGULATION

BACKGROUND OF THE INVENTION

1. Field of the Invention

The present invention generally relates to an electrical connector, and in particular to a Universal Serial Bus (USB) connector having a built-in resettable power regulation device for protecting an electrical device connected thereto.

2. The Prior Art

An electrical connector, such as a USB connector, transmits electrical signals, including data signals and power signals, between electrical parts and/or devices. An example of a USB connector is disclosed in Taiwan Patent Application No. 85213720. An excessive-current or excessive-voltage power signal transmitted through an electrical connector may damage electrical parts or devices connected thereto. To avoid damage caused by the excessive-current signal or excessive-voltage signal, a power regulating device is often incorporated in a circuit board to which an electrical device is connected via the connector. The regulating device occupies a significant amount of space on the circuit board and increases costs. Thus, it is desired to provide an electrical connector in which a resettable power regulation device is incorporated for protecting an external electrical device connected thereto from being damaged by an excessive-current or excessive-voltage signal.

SUMMARY OF THE INVENTION

Accordingly, an object of the present invention is to provide an electrical connector having a resettable power regulation device disposed therein.

Another object of the present invention is to provide an electrical connector capable of protecting an external electrical device connected thereto from being damaged by an excessive-current or excessive-voltage signal transmitted therethrough.

To achieve the above objects, an electrical connector in accordance with the present invention comprises an insulative housing retaining signal and power contacts therein. A resettable power regulation device is attached to the housing and electrically connected to the power contacts whereby an excessive-power condition caused by an excessive-current or excessive-voltage power signal triggers a shut-down operation of the regulation device thereby terminating the transmission of the power signal to protect an electrical device connected to the connector. The resettable power regulation device resumes transmission when the power condition is decreases to an operational level.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1A:
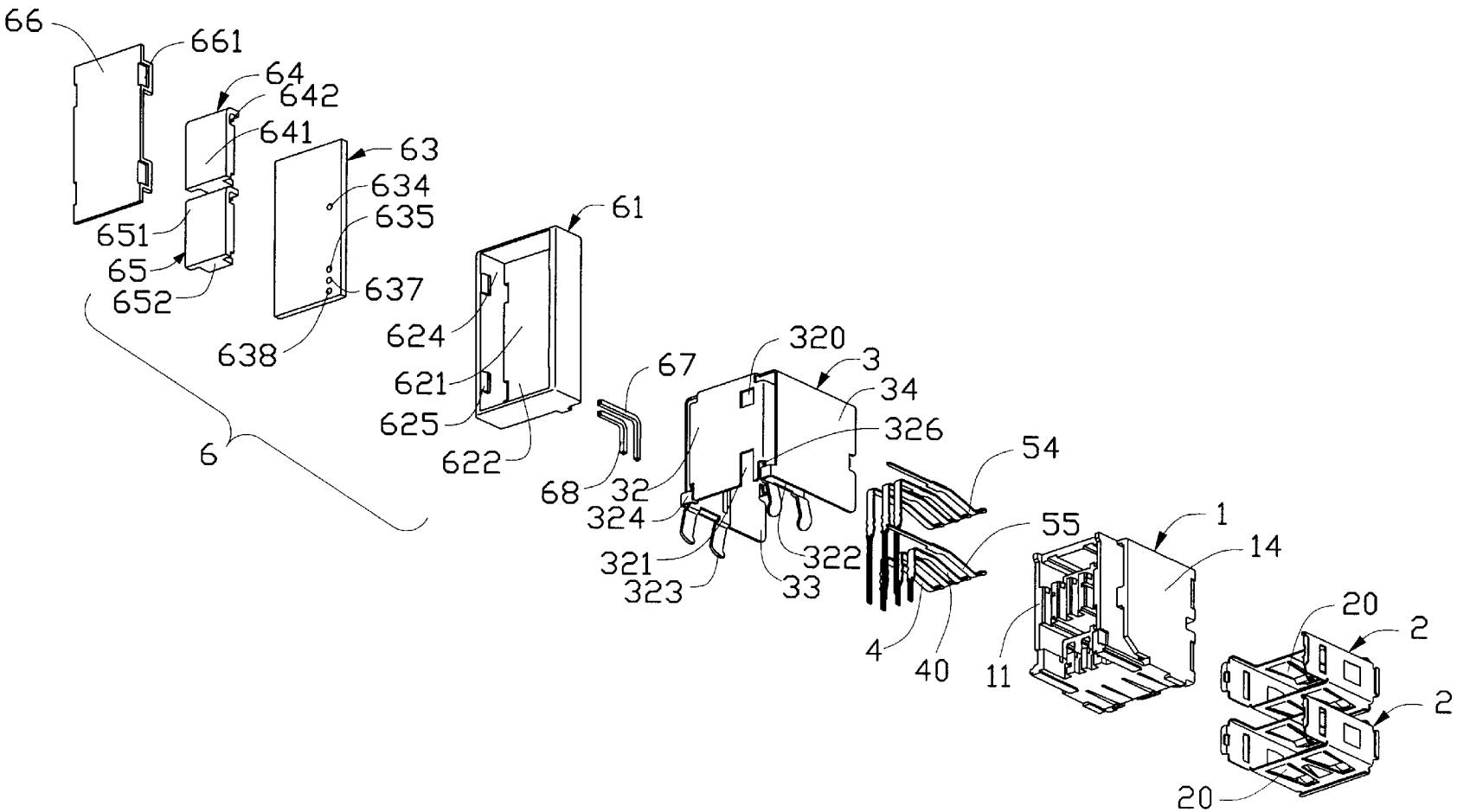
FIG. 1A is an exploded view of an electrical connector constructed in accordance with the present invention.
Figure 1B:
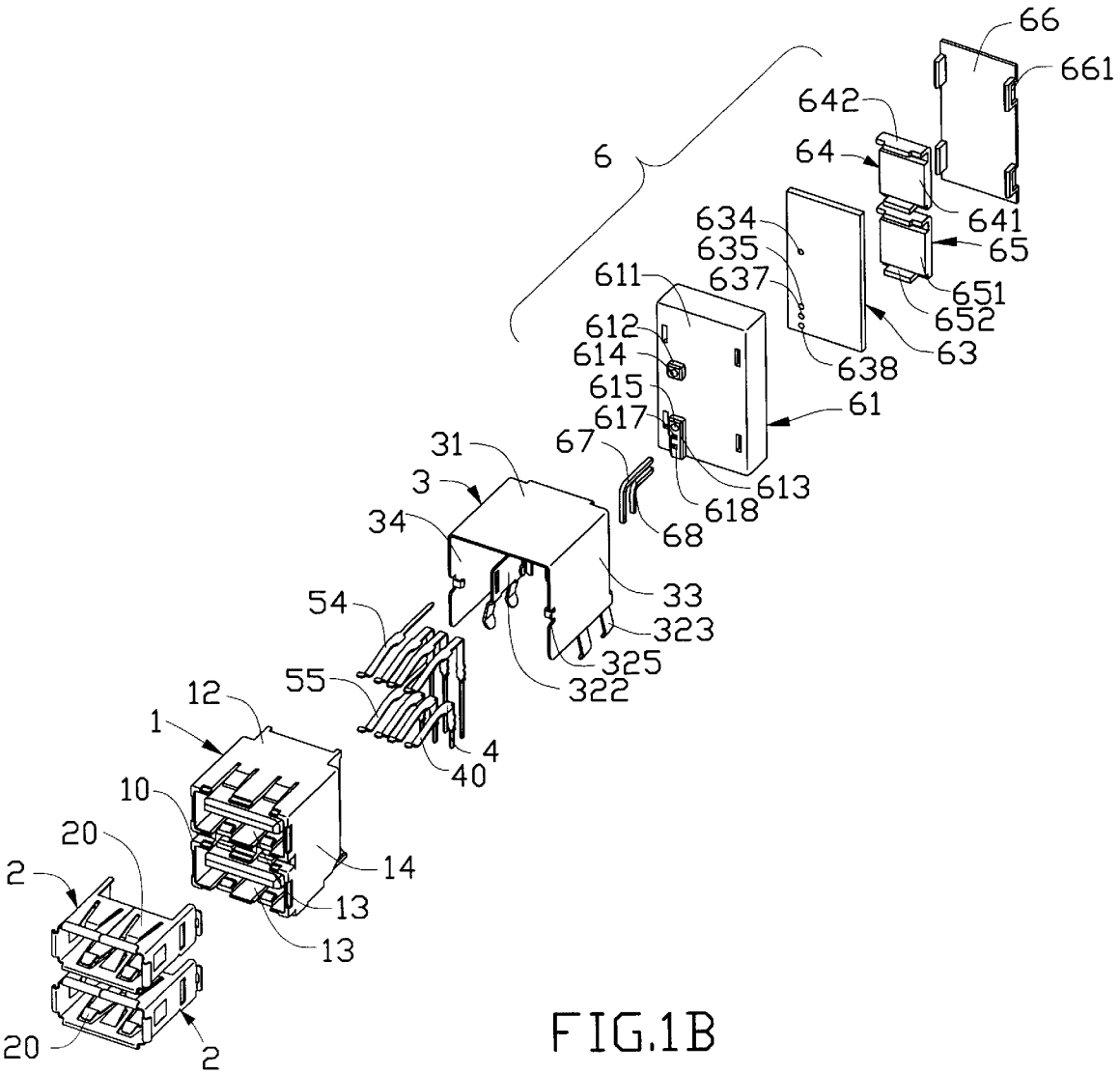
FIG. 1B is an exploded view of the electrical connector taken from a different perspective.

Referring to the drawings and in particular to FIGS. 1A and 1B, an electrical connector constructed in accordance with the present invention comprises an insulative housing 1 defining two receiving slots 13 therein, two inner shielding members 2 received and retained in the receiving slots 13 and an outer shielding member 3 substantially enclosing the housing 1. A plurality of signal contacts 4 and power contacts 54, 55 is retained in the housing 1 with mating sections 40 of the signal contacts 4 received in each of the receiving slots 13 and adapted to electrically engage with mating connectors (not shown) inserted into the receiving slots 13. Each inner shielding member 2 has resilient barbs 20 formed on opposite surfaces thereof for engaging with and retaining the mating connector inserted in the corresponding receiving slot 13.

A resettable power regulation device 6 is incorporated in the connector and is electrically connected to the power contacts 54, 55 for terminating power transmission through the power contacts 54, 55 when an excessive-power condition occurs.

The insulative housing 1 has a front mating face 10 and a rear face 11. The housing 1 further has a top face 12 and two side faces 14. The outer shielding member 3 comprises a top panel 31 positioned on the top face 12 of the housing 1, and a rear panel 32 and two side panels 33, 34 extending from the top panel 31 for shielding and/or abutting against the rear face 11 and the side faces 14, respectively. Two openings 320, 321 are defined in the rear panel 32 through which the power contacts 54, 55 extend. The rear panel 32 forms two side extensions 322 on each vertical edge thereof for insertion into the corresponding receiving slots 13 of the housing 1 to engage with the corresponding inner shielding members 2. Mounting tabs 323 extend from the lower side extensions 322 for being mounted to a circuit board (not shown). Each side panel 33, 34 has an inwardly-bent front flange 325 for engaging with the front face 10 thereby retaining the outer shielding member 3 to the housing 1, and an inwardly-bent rear flange 324 for engaging with a notch 326 defined in the corresponding side extension 322 of the rear panel 32 for fixing the side extensions 322 in position.

Figure 2A:
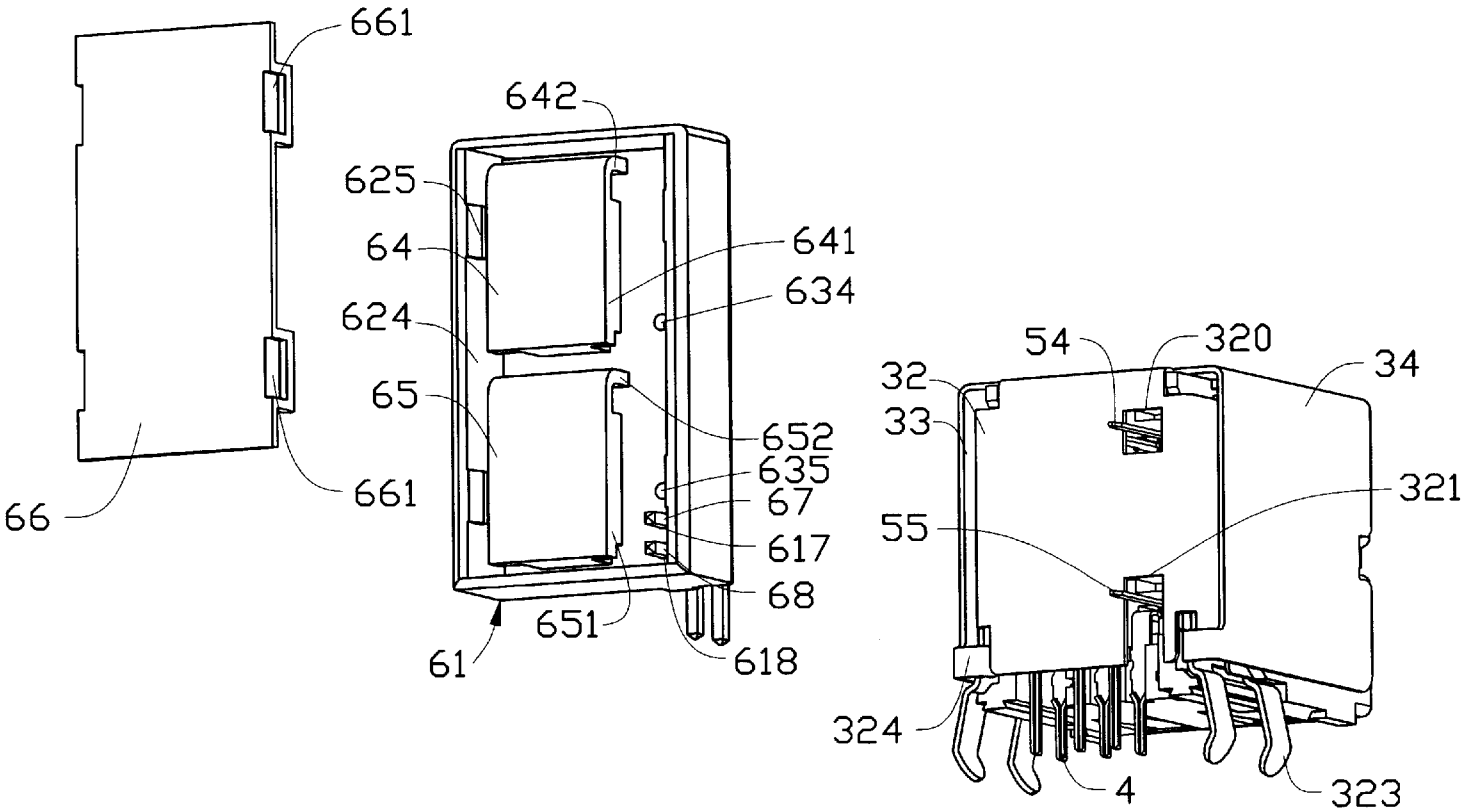
FIG. 2A is a perspective view of the electrical connector and a power regulation device thereof.
Figure 2B:
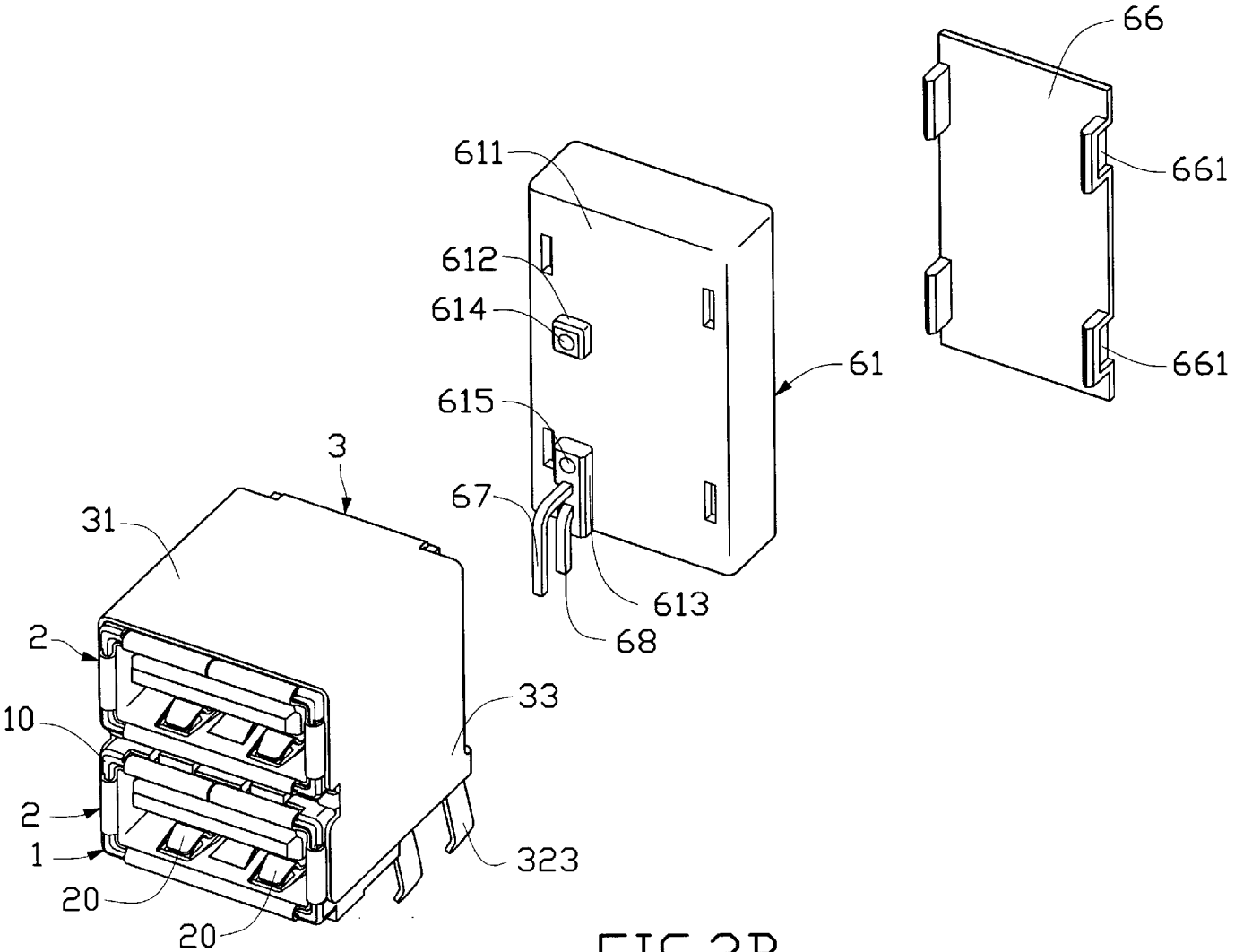
FIG. 2B is similar to FIG. 2A but taken from a different perspective.
Figure 3:
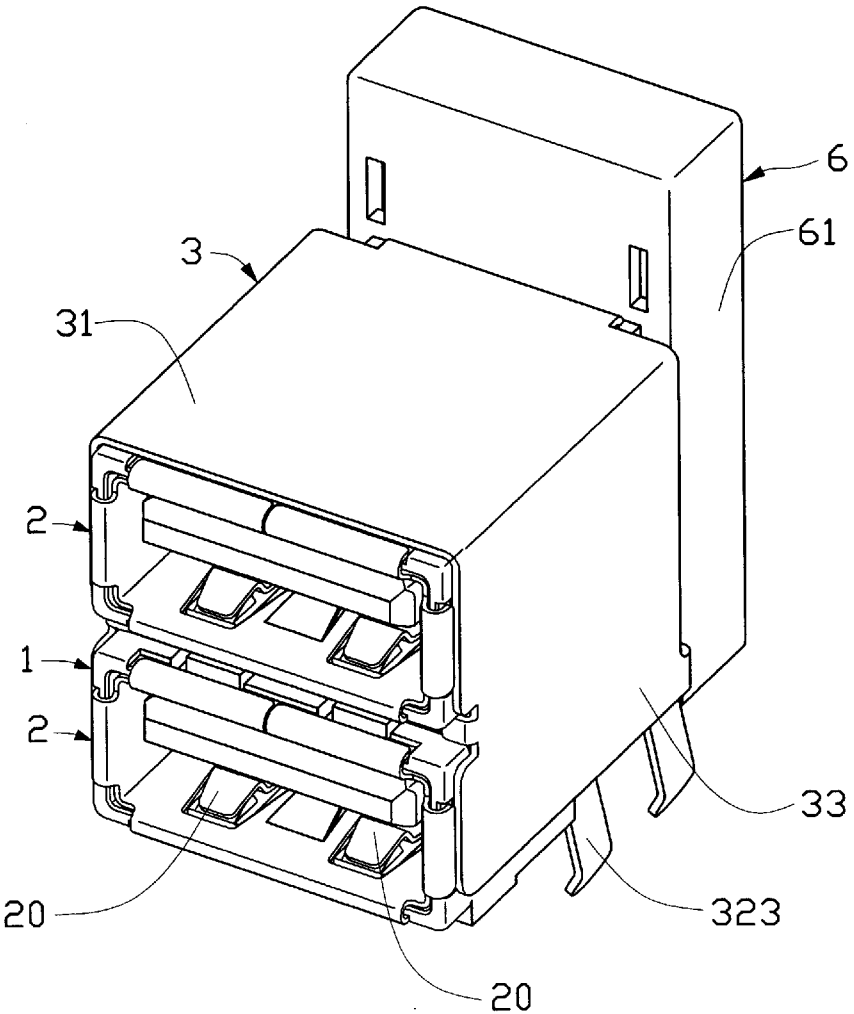
FIG. 3 is an assembled view of FIG. 1B.

Also referring to FIGS. 2A, 2B and 3, the resettable power regulation device 6 comprises a casing 61 having a first face 611 abutting against and fixed to the rear panel 32 of the outer shielding member 3 by means of soldering. Raised sections 612, 613 are formed on the first face 611 of the casing 61 for interferentially fitting into the openings 320, 321 for positioning and attaching purposes. First through holes 614, 615 are defined in the raised sections 612, 613 of the casing 61 for the extension of the power contacts 54, 55 therethrough. Second through holes 617, 618 are also defined in the raised section 613 for receiving external power terminals 67, 68. It is also noted that the power contacts 54, 55 and the external power terminals 67, 68 are generally aligned with one another, the external power terminals 67, 68 may extend into the housing 1 through the lower strap type opening 321 when the housing 1 and the regulation device 6 are attached with each other.

The casing 61 has surrounding side walls 624 formed on a second face 621 thereof thereby defining an interior space 622. A circuit board 63 on which two independent power interrupting devices 64, 65, such as polyswitches, are mounted is received and retained in the interior space 622. Each power interrupting device 64, 65 comprises a device body 641, 651 electrically connected to the circuit board 63 by means of extensions 642, 652 thereof. Through holes 634, 635, 637, 638 are defined in the circuit board 63 for receiving the power contacts 54, 55 and the external power terminal members 67, 68. The power contacts 54, 55 extend through the holes 634, 635 to engage with the power interrupting devices 64, 65. The external power terminals 67, 68 are soldered to the circuit board 63. The power interrupting devices 64, 65 connect the power contacts 54, 55 to the corresponding external power terminals 67, 68, and function to interrupt the connection when an excessive-power condition occurs in the power contacts 54, 55 for protection purposes. The poly-switches 64, 65 are resettable after the power condition decreases to an operational level.

A cover 66 is attached to the casing 61 for closing the space 622 and shielding the power interrupting devices 64, 65 by means of recesses 661 defined therein engaging with barbs 625 formed on an inside surface of the surrounding side walls 624.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

an insulative housing defining at least one receiving slot adapted to receive a mating connector;

a plurality of signal contacts and one power contact received and retained in the receiving slot for electrically engaging with the mating connector; and a power regulation device attached to the housing and forming an interruptable connection between the power contact and an external power terminal for transmitting a power signal therebetween, the power regulation device interrupting the connection when an excessive-power condition occurs.

2. The electrical connector as claimed in claim 1, wherein the power regulation device comprises a casing attached to the housing, power interrupting means being retained in the casing and electrically connecting between the power contact and the external power terminal.

3. The electrical connector as claimed in claim 2, wherein the power interrupting means comprises a circuit board on which a poly-switch is mounted, the power contact engaging with the poly-switch, the external power terminal being connected to the circuit board.

4. The electrical connector as claimed in claim 2, wherein the power regulation device further comprises a cover attached to the casing to shield the power interrupting means.

5. The electrical connector as claimed in claim 1, wherein an outer shielding member encloses the housing.

6. The electrical connector as claimed in claim 5, wherein an inner shielding member is fit in the receiving slot to shield the signal contacts.

7. The electrical connector as claimed in claim 1, wherein the housing defines two receiving slots each retaining signal contacts and a power contact therein, each power contact corresponding to an external power terminal.

8. The electrical connector as claimed in claim 7, wherein the power regulation device comprises a casing attached to the housing, power interrupting means being retained in the casing and independently and electrically connecting between the power contacts and the external power terminals.

9. The electrical connector as claimed in claim 8, wherein the power interrupting means comprises a circuit board on which two poly-switches are mounted, the power contacts engaging with the corresponding poly-switches, the external power terminals being connected to the circuit board.

10. The electrical connector as claimed in claim 8, wherein the power regulation device further comprises a cover attached to the casing to shield the power interrupting means.

11. An electrical connector assembly comprising:

an insulative housing;

a plurality of signal contacts and at least one power contact provided in the housing; and a power regulation device attached to the housing; wherein the signal contacts are bent at a right angle for not engaging the attached power regulation device and mounting to a printed circuit board on which the connector assembly is mounted, while said power contact is directed to engage with the power regulation device.

12. The connector assembly as claimed in claim 11, wherein the power regulation device is attached to the back of the housing, and is relatively higher but thinner than said housing.

13. The connector assembly as claimed in claim 11, wherein the housing includes an outer shielding member, of which a rear panel defines at least one opening through which the power contact extends.

14. A connector assembly including:

an insulative housing;

a plurality of signal contacts and at least one power contact provided in the housing;

a shielding member enclosing said housing; and a power regulation device attached to the housing with at least one external power terminal; wherein said shielding member defining an opening through which said power contact and said external power contact extend to each other in opposite directions.

* * * * *